US007271767B2

(12) United States Patent
Londre

(10) Patent No.: US 7,271,767 B2
(45) Date of Patent: Sep. 18, 2007

(54) BEAMFORMING ARCHITECTURE FOR MULTI-BEAM PHASED ARRAY ANTENNAS

(75) Inventor: Dale A. Londre, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 419 days.

(21) Appl. No.: 10/707,211

(22) Filed: Nov. 26, 2003

(65) Prior Publication Data

US 2005/0110681 A1 May 26, 2005

(51) Int. Cl.
*H01Q 1/38* (2006.01)

(52) U.S. Cl. ..... 343/700 MS; 343/853

(58) Field of Classification Search ..... 343/700 MS, 343/793, 850, 856, 702, 778, 853, 893, 895; 342/354, 372, 371
See application file for complete search history.

(56) References Cited

U.S. PATENT DOCUMENTS 4,929,959 A * 5/1990 Sorbello et al. ..... 343/700 MS
5,086,304 A * 2/1992 Collins ..... 343/778
5,293,171 A * 3/1994 Cherrette ..... 343/700 MS
5,512,906 A * 4/1996 Speciale ..... 342/375
5,623,269 A * 4/1997 Hirshfield et al. ..... 342/354
5,963,167 A * 10/1999 Lichten et al. ..... 342/357.06
6,232,920 B1 * 5/2001 Brookner et al. ..... 342/372
6,239,764 B1 * 5/2001 Timofeev et al. ..... 343/795
6,249,439 B1 6/2001 DeMore et al. ..... 363/905
6,297,775 B1 10/2001 Haws et al. ..... 343/853
6,356,245 B2 3/2002 Metzen et al. ..... 343/700 MS
6,424,313 B1 7/2002 Navarro et al. ..... 343/853
6,429,816 B1 * 8/2002 Whybrew et al. ... 343/700 MS
6,480,167 B2 11/2002 Mattews ..... 343/795
6,646,621 B1 * 11/2003 Phelan et al. ..... 343/895
6,842,157 B2 * 1/2005 Phelan et al. ..... 343/893
6,963,307 B2 * 11/2005 Mohamadi ..... 343/700 MS

* cited by examiner

*Primary Examiner*—Douglas W. Owens
*Assistant Examiner*—Jimmy Vu
(74) *Attorney, Agent, or Firm*—Ostrager Chong Flaherty & Broitman P.C.

(57) ABSTRACT

A first subarray beamformer for a multi-beam phased array antenna (12) used in a receiving mode includes multiple phased array antenna beamforming layers. The beamforming layers include a first beamforming layer (90) that may have a first series of combiners in a first orientation. The first series of combiners combine a first set of signals to form a second set of signals. A second beamforming layer (110) may have a second series of combiners in a second orientation that are coupled to and oppose the first series of combiners. The second series of combiners combine the second set of signals to form a first combined signal. A second subarray beamformer for a multi-beam phased array antenna used in a transmitting mode that has a similar configuration as that of the first subarray beamformer, but includes dividers rather than combiners.

29 Claims, 7 Drawing Sheets

BEAMFORMING ARCHITECTURE FOR MULTI-BEAM PHASED ARRAY ANTENNAS

BACKGROUND OF INVENTION

The present invention is related generally to satellite communication systems. More particularly, the present invention is related to an assembly for combining communication signals within a beamforming architecture of a multi-beam phased array antenna.

Multi-beam antennas are used in a variety of communication applications, such as on satellites. Current multi-beam antennas are divided into two classes, the fixed spot beam type and the multi-beam phased array type. The fixed spot beam type antennas require additional design investment, such as in componentry and system control, to provide beam pointing and shape altering capability. The multi-beam phased array type antennas can be electronically reconfigured without such design investment, but are commonly formed in a "brick" type architecture. The brick architecture has significant height and a substantial amount of components.

Phase array antennas typically include multiple radiating elements, element and signal control circuits, a signal distribution network, a power supply, and a mechanical support structure. Integration of these components can be time consuming and interconnections contained therein can degrade reliability of an antenna. Also, due to limited space on a satellite, there is a limited amount of area on the non-signal transmission side of the radiating element of the antenna for the above stated circuitry and structures.

A multi-beam phased array antenna often has multiple RF inputs, which are referred to as elements. For aperture efficiency and reuse, each element has a single input antenna to capture or radiate RF energy followed by an amplifier. For multi-beam applications, the received input signal is divided into N signals that correspond to an N number of resulting beams after amplification. After division, a beamformer applies amplitude and phase weighting to each channel of each element. For an array of M elements and N beams, there are M×N weighting circuits or beamforming paths. The signal energy from each beam and each element is combined in a power combiner, which has an N number of layers. For M elements and N beams, a quantity of N, M-to-one combiners are required.

Packaging radio frequency (RF) beamforming circuitry for multiple beams in the available space on the non-signal side of the radiating elements can require configuring the circuitry and structures in a vertical fashion. This vertical arrangement increases height of the antenna.

Also, the use of a vertical arrangement results in the use of separate modules for each of the beamforming circuits with many interconnections between the modules and power combining circuitry. The interconnections can negatively affect reliability and correspond to an increase in associated components. The interconnections and the associated costs involved therein increase costs in an antenna and increase componentry integration time. The physical size of the antenna also limits the mounting locations for the antenna.

Thus, there exists a need for an improved multiple phased array antenna having an electrical coupling and packaging configuration that minimizes antenna size, the number of interconnections, component and manufacturing costs, and integration time.

SUMMARY OF INVENTION

The present invention provides a first subarray beamformer for a multi-beam phased array antenna. The first subarray beamformer is used in a receiving mode and includes multiple phased array antenna beamforming layers. The beamforming layers include a first beamforming layer that may have a first series of combiners in a first orientation. The first series of combiners combine a first set of signals to form a second set of signals. A second beamforming layer may have a second series of combiners in a second orientation that are coupled and orthogonal to the first series of combiners. The second series of combiners combine the second set of signals to form a first combined signal.

A second subarray beamformer for a multi-beam phased array antenna is also provided. The second subarray beamformer may be used to provide additional receive beams or may be used in a transmitting mode that has a similar configuration as that of the first subarray beamformer, but includes dividers rather than combiners.

The embodiments of the present invention provide several advantages. One such advantage that is provided by multiple embodiments of the present invention is the provision of subarray beamformer configured such that the number of beamforming, combining, and dividing layers within a phased array antenna is reduced. The reduced number of modules and layers reduces the number of separable interconnections within a phased array antenna.

Another advantage that is provided by multiple embodiments of the present invention is the provision of simplifying the layers within a subarray beamformer, which further reduces the number of separable interconnections within a phased array antenna.

The above stated advantages in reducing the number of interconnections, minimize integration time and manufacturing costs, and improve reliability of a phased array antenna.

The present invention itself, together with further objects and attendant advantages, will be best understood by reference to the following detailed description, taken in conjunction with the accompanying drawing.

DETAILED DESCRIPTION

Figure 1:
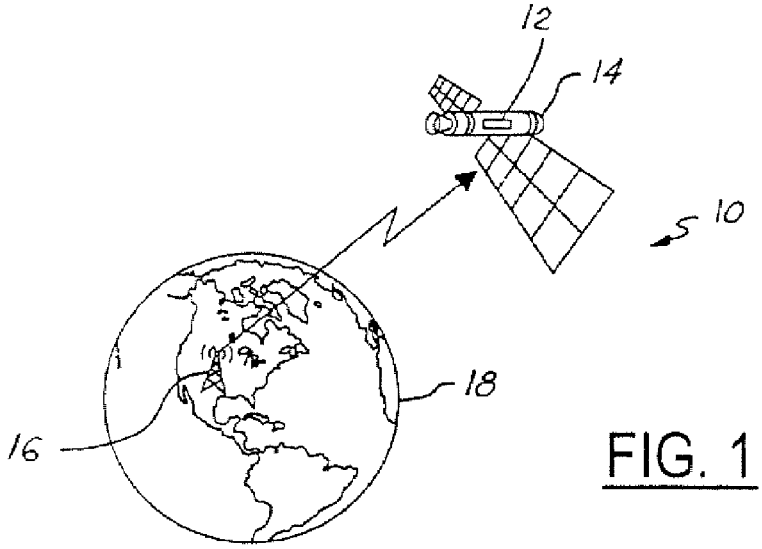
FIG. 1 is an elevational view of a satellite communication system incorporating a multi-beam phased array antenna assembly in accordance with an embodiment of the present invention.

In the following figures, the same reference numerals will be used to refer to the same components. While the present invention is described with respect to an assembly for combining communication signals within a beamforming architecture of a multi phased array antenna, the present invention may be adapted for use in various applications known in the art. The present invention may be applied in military and civilian applications. The present invention may be applied to aerospace systems, communication systems, spacecraft systems, telecommunication systems, intelligent transportation systems, global positioning systems, and other systems known in the art. Although the present invention is described primarily with respect to a multi-beam phased array antenna, the present invention may be applied to other antennas known in the art.

In the following description, various operating parameters and components are described for one constructed embodiment. These specific parameters and components are included as examples and are not meant to be limiting.

Referring now to FIG. 1, an elevational view of a satellite communication system 10 incorporating a multi-beam phased array antenna assembly 12 in accordance with an embodiment of the present invention is shown. The satellite communication system 10 includes a satellite 14 that has the antenna assembly 12. The satellite 14 utilizes the antenna assembly 12 in communication with the ground station 16 on the earth 18. Although a single satellite, multi-beam phased array antenna assembly, and ground station are shown, any number of each may be included within the communication system 10.

Figure 2:
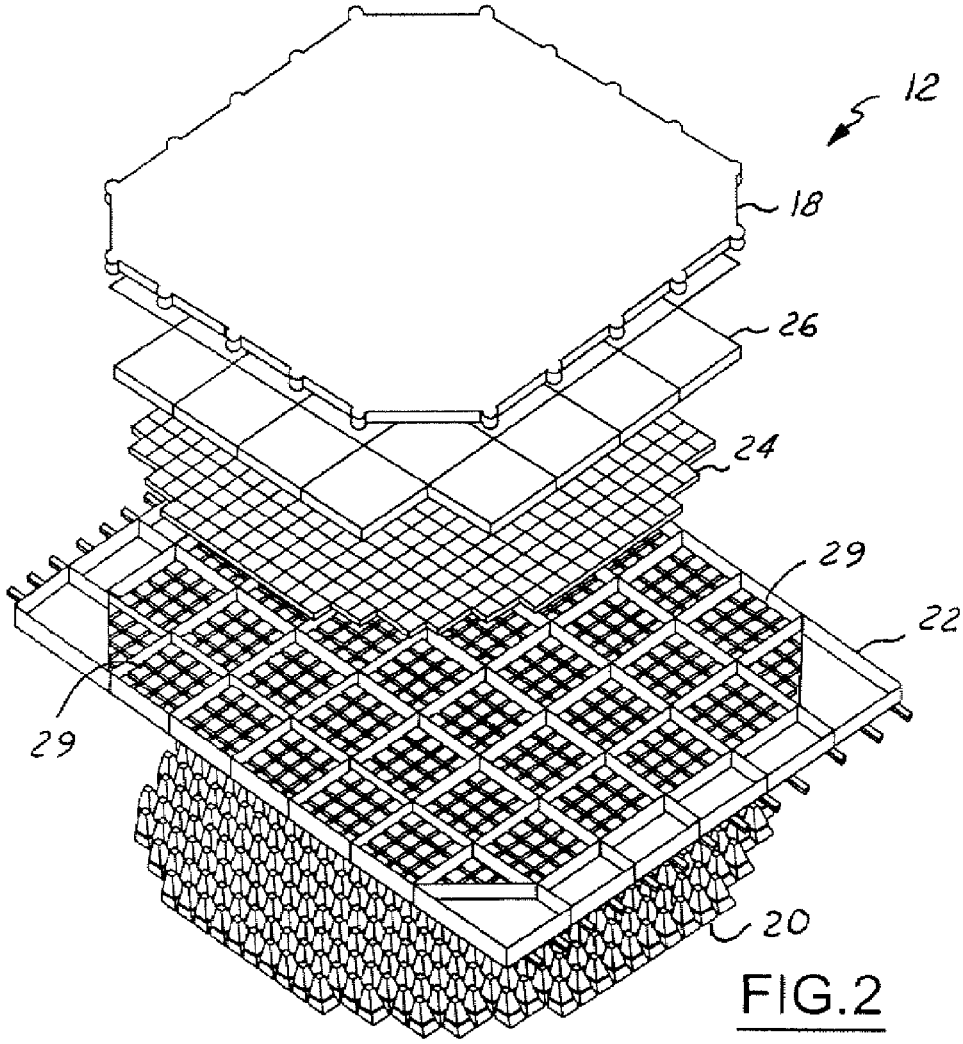
FIG. 2 is an exploded view of the multi-beam phased array antenna assembly of FIG. 1 in accordance with an embodiment of the present invention.

Referring now to FIG. 2, an exploded view of the antenna assembly 12 in accordance with an embodiment of the present invention is shown. The antenna assembly 12 includes an array of radiating elements 20, which are mounted to a common array structure 22. An array of signal conditioners 24 is mounted within and on an opposite side of the array structure 22 as that of the radiating elements 20. The signal conditioners 24 are coupled to the radiating elements 20 through the array structure 22. A subarray beamformer or beamforming board 26 is coupled to the signal conditioners 24. A cover 28 resides over the beamforming array and is coupled to the array structure 22. The antenna assembly 12 may be operated in a transmit mode or a receive mode.

The radiating elements 20 perform as antennas and transmit or receive communication signals to and from the antenna assembly 12. The radiating elements 20 may be of various sizes, shapes, and types and may transmit and receive signals of various strengths, wavelengths, and polarizations. There may be any number of radiating elements 20 included within the antenna assembly 12. The radiating elements 20 may be in various arrangements known in the art.

The array structure 22, although being shown in the form of a circuit housing, may be in various other forms. The array structure provides a simple, compact, and efficient technique for rigidly holding and containing the phased array antenna circuitry, such as the signal conditioners 24 and the beamforming board 26. The array structure 22 provides a mounting platform and coupling mechanism for the radiating elements 20, the signal conditioners 24, and the beamforming board 26. The array structure 22 may include other circuitry, some of which is shown with respect to the embodiment of FIG. 3. Although the array structure 22 is illustrated as being divided into thirty-six 4×4 subarrays 29, the array structure 22 may be divided into any number of subarrays having any number of columns and rows, as is further stated with respect to the embodiment of FIG. 4.

The signal conditioners 24 in general adjust gain and phase of the communication signals. The signal conditioners 24 may include amplifiers, such as low noise amplifiers, solid-state power amplifiers, phase correction circuitry, and other circuitry, such as electrical or electronic components known in the art.

The beamforming board 26 forms combined signals from the communication signals received by the antenna assembly 12 when in a receive mode and forms communication signals from the combined signals when in a transmit mode. The beamforming board 26 is configured such that there are fewer beam forming layers within the beamforming board 26 than there are radiating elements 20 or communication signal beams. The beamforming board 26 performs similar functions as that of traditional beamforming circuitry and power combiners, but in a simple, compact, and efficient manner. Configuration of the beamforming array 26 is described in further detail below.

The cover 28 in combination with the array structure 22 provide a protective and contained housing for the signal conditioners 24 and beamforming board 26. The cover 28, as with the array structure 22, may be formed of various materials known in the art.

Figure 3:
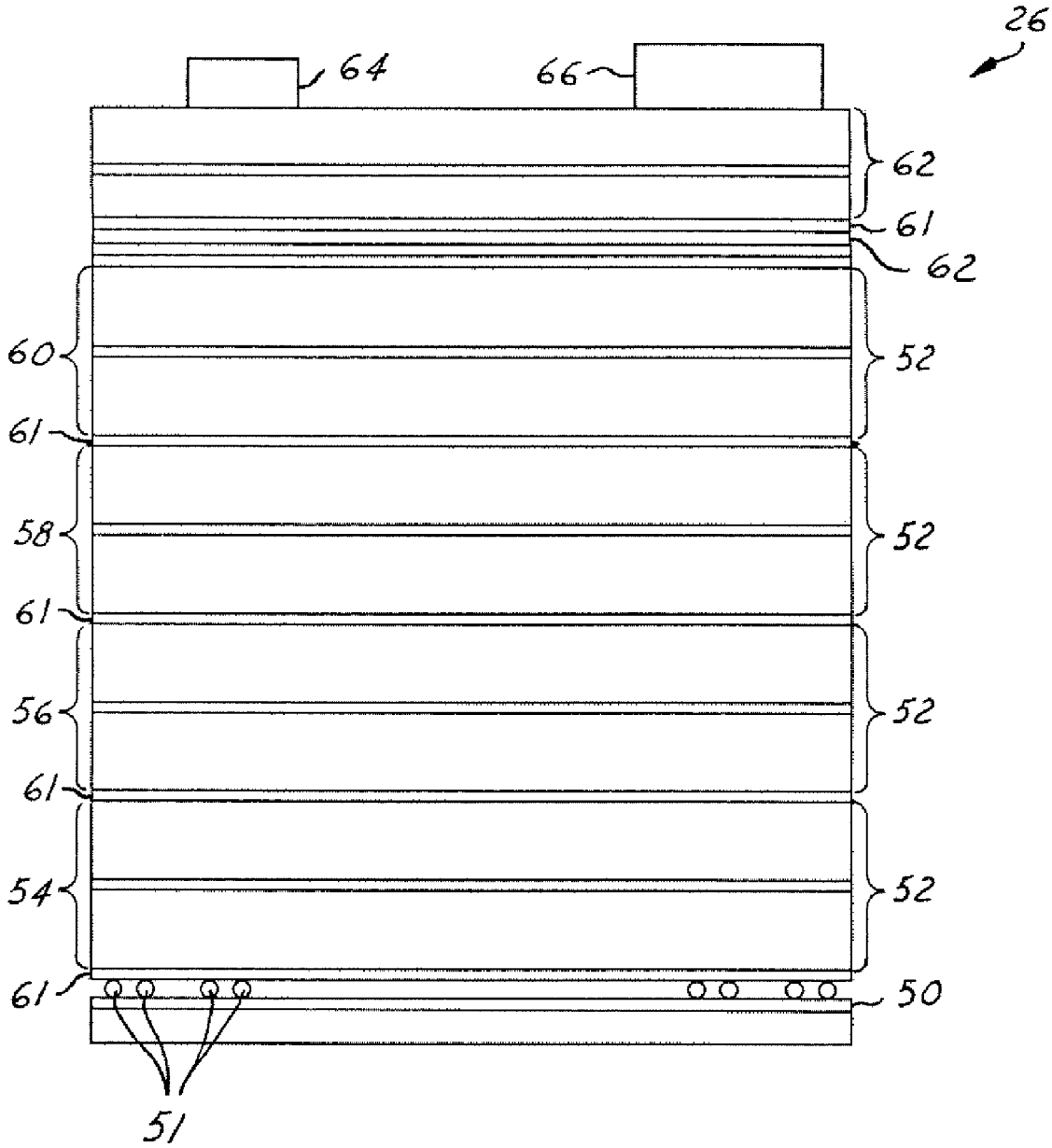
FIG. 3 is a cross-sectional view of a beamforming board in accordance with an embodiment of the present invention.

Referring now to FIG. 3, a cross-sectional view of the beamforming board 26 assembled and in accordance with an embodiment of the present invention is shown. The beamforming board 26 may be in the form of a multilayer circuit board, as shown. The beamforming board 26 includes subarrary tile element or layers 50. The tile elements 50 may be directly coupled to the beamforming board 26 or may be coupled via connectors 51.

The beamforming board 26 is formed of multiple stripline layers or beamforming layers 52. The beamforming layers 52 include a first beamforming layer 54, a second beamforming layer 56, a third beamforming layer 58, and a fourth beamforming layer 60. Although the beamforming board 26 is shown as having four beamforming layers 52, any number may be utilized, which is explained in further detail below. The beamforming layers 52 are formed over and adjacent to the beamforming element layer 50. Each beamforming layer 52 is coupled to an adjacent layer, device, or array through use of conductive via or conductive connections 61 therebetween. Each of the beamforming layers 52 may be formed of organic and ceramic materials, as known in the art. Each of the beamforming layers may be adhesively coupled to adjacent layers, devices, and arrays.

The beamforming board 26 may also include additional layers and devices for added functionality. For example, in the embodiment as illustrated, the beamforming board 26 includes direct current (DC) and signal control routing layers 62, a power filtering device 64, and a ball grid array 66. The added layers and devices provide additional signal control and connection support.

Figure 4:
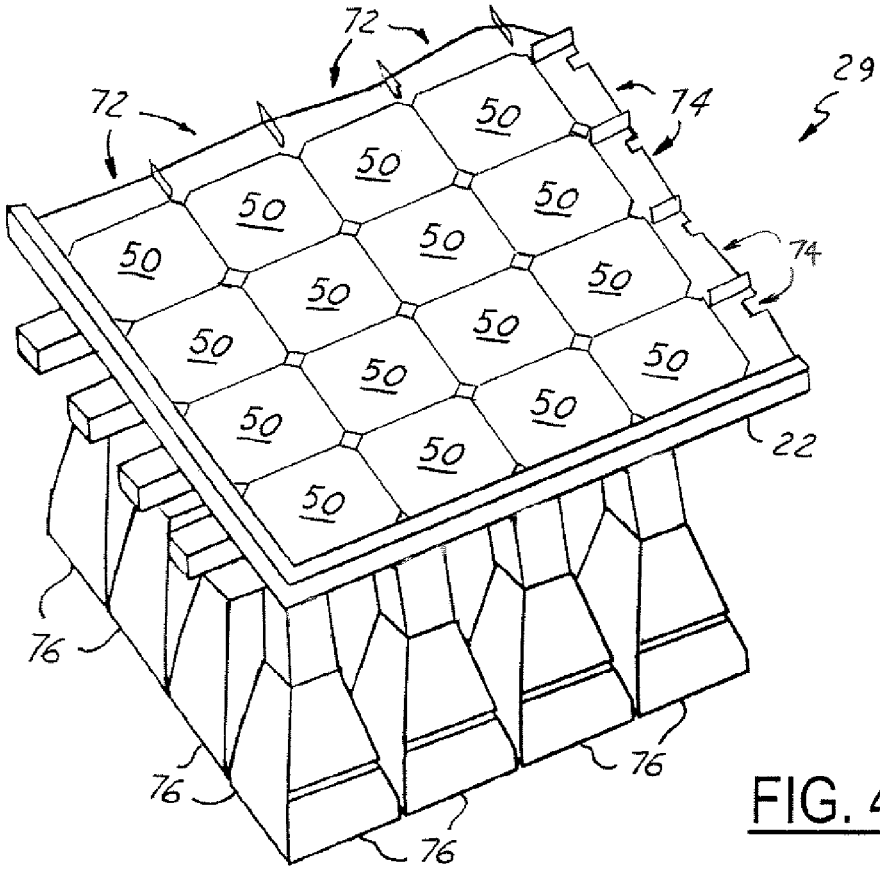
FIG. 4 is a perspective view of a subarray of radiating elements of the phased array antenna of FIG. 1 in accordance with an embodiment of the present invention.
Figure 5:
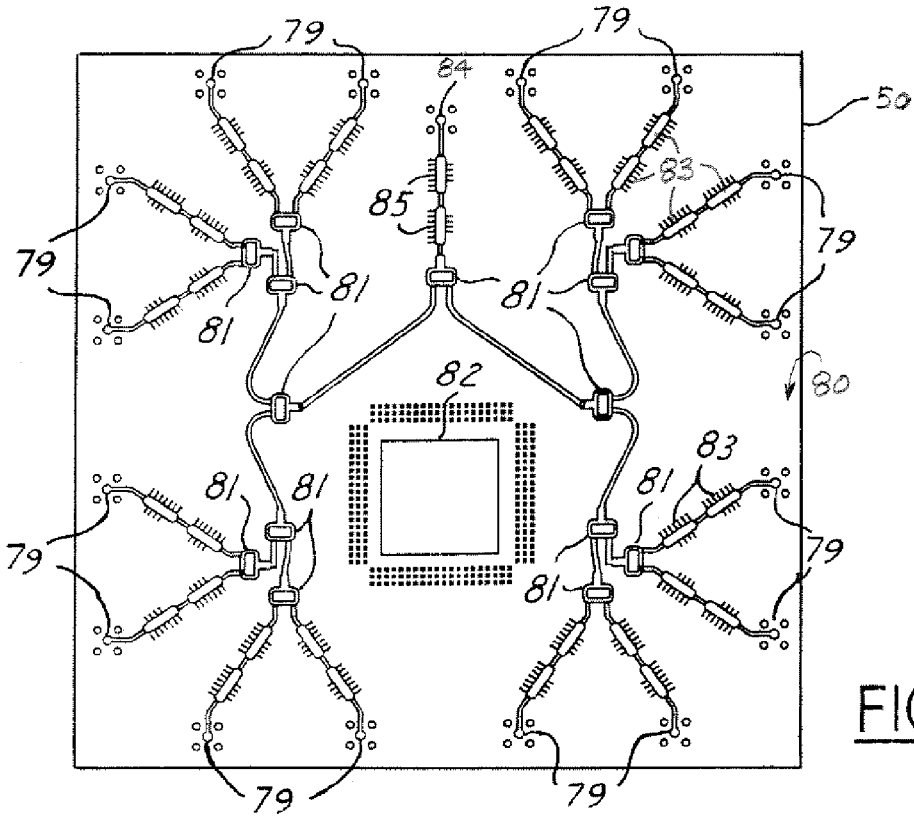
FIG. 5 is a top schematic view of a subarray tile illustrating connection element arrangement thereon and in accordance with an embodiment of the present invention.

Referring now to FIG. 4, a perspective view of a subarray 29 for a portion of the radiating element 20 in accordance with an embodiment of the present invention is shown. The subarray 29 is shown as a 4×4 subarray of the beamforming board 26. The subarray 29 has four columns 72 and four rows 74. The subarray 29 is coupled to sixteen radiating elements 76 via the signal conditioner array 24 (not shown). Each radiating element 76 receives or transmits power corresponding to each of the sixteen beams (not shown), which are received by each tile element 50. Each tile element 50 resides within the array structure 22 and is coupled to a signal conditioner 24. Each tile element 50 may reside above or below the beamforming board 26. Each beam received or transmitted by the radiating elements 76 has a corresponding radio frequency (RF) connector location or input/output connection element 84 in each tile element 50, as shown in FIG. 5. Although the subarray 29 is shown as a 4×4 subarray, subarray 29 may have any number of subarray columns and rows.

Referring now to FIG. 5, a top schematic view of one of the subarray tile elements 50 illustrating connection element arrangement thereon and in accordance with an embodiment of the present invention is shown. The tile element 50 is shown as having sixteen signal connection elements, elements 79, which are arranged symmetrically around a periphery 80 of the tile 50. This allows positioning combiners or dividers for multiple beams on the same beamforming layer. Variable phase shifters and attenuators 83 reside between the elements 79 and tile combiner/dividers 81.

Signal power received from or transmitted to the tile elements 50 is combined or divided by the beamforming array 26. The tile elements 50 include the combiner/dividers 81 that are coupled on the tile 50 between the connection elements 79 and a controller 82. Each beam is combined separately and simultaneously and is transmitted or received through the input/output 84. Amplifiers 85 reside between the combiner/dividers 81 and the input/output 84.

The controller 82 controls amplitude and phase of the beams and in so doing controls steering angle of the beams. The controller 82 may be microprocessor based, be in the form of an application specific integrated circuit (ASIC), or be formed of other logic devices known in the art.

In the following FIGS. 6A–7B, although orthogonal orientations are provided, other orientations may be envisioned by one skilled in the art.

Figure 6A:
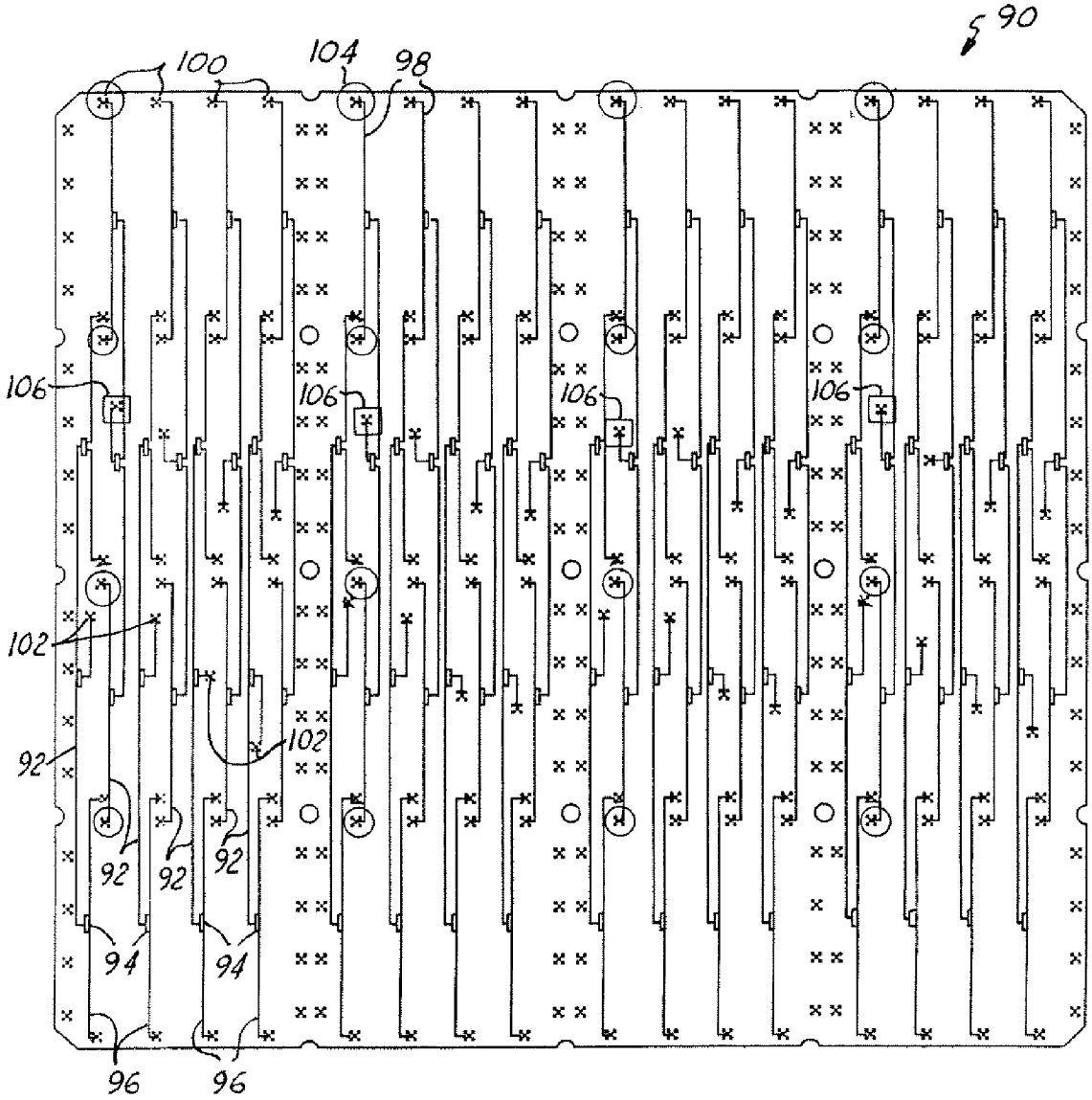
FIG. 6A is a schematic view of a first beamforming layer of the subarray of FIG. 4 in accordance with an embodiment of the present invention.

Referring now to FIG. 6A, a schematic view of a first beamforming layer 90 of the subarray 29 in accordance with an embodiment of the present invention is shown. The first beamforming layer 90 includes a first series of combiner/dividers strips 92, which are unidirectionally oriented across the subarray 29. Each strip 92 has one or more combiners/dividers 94, which combine a first set of signals to form a second set of signals or divide the second set of signals to form the first set of signals, depending upon the mode of operation. The first set of signals corresponds with the connection elements 100 and the second set of signals correspond with the input/outputs connection elements 102. For the embodiment as described, the first beamforming layer 90 includes thirty-two four-to-one combiner/divider strips. A first half of the strips 96 are offset from a second half of strips 98 to efficiently utilize cross-sectional area of the subarray 29. The strips are grouped by columns 72 of the subarray 29.

Each strip includes four signal elements 100 and a single input/output connection element 102. Circles 104 designate the sixteen signal elements for a first beam and a first subarray. Input/output elements 102 of the strips 92 for the first beam are noted by squares 106. The strips 92 may be in the form of a tree like structure as shown or may be in some other form known in the art.

Figure 6B:
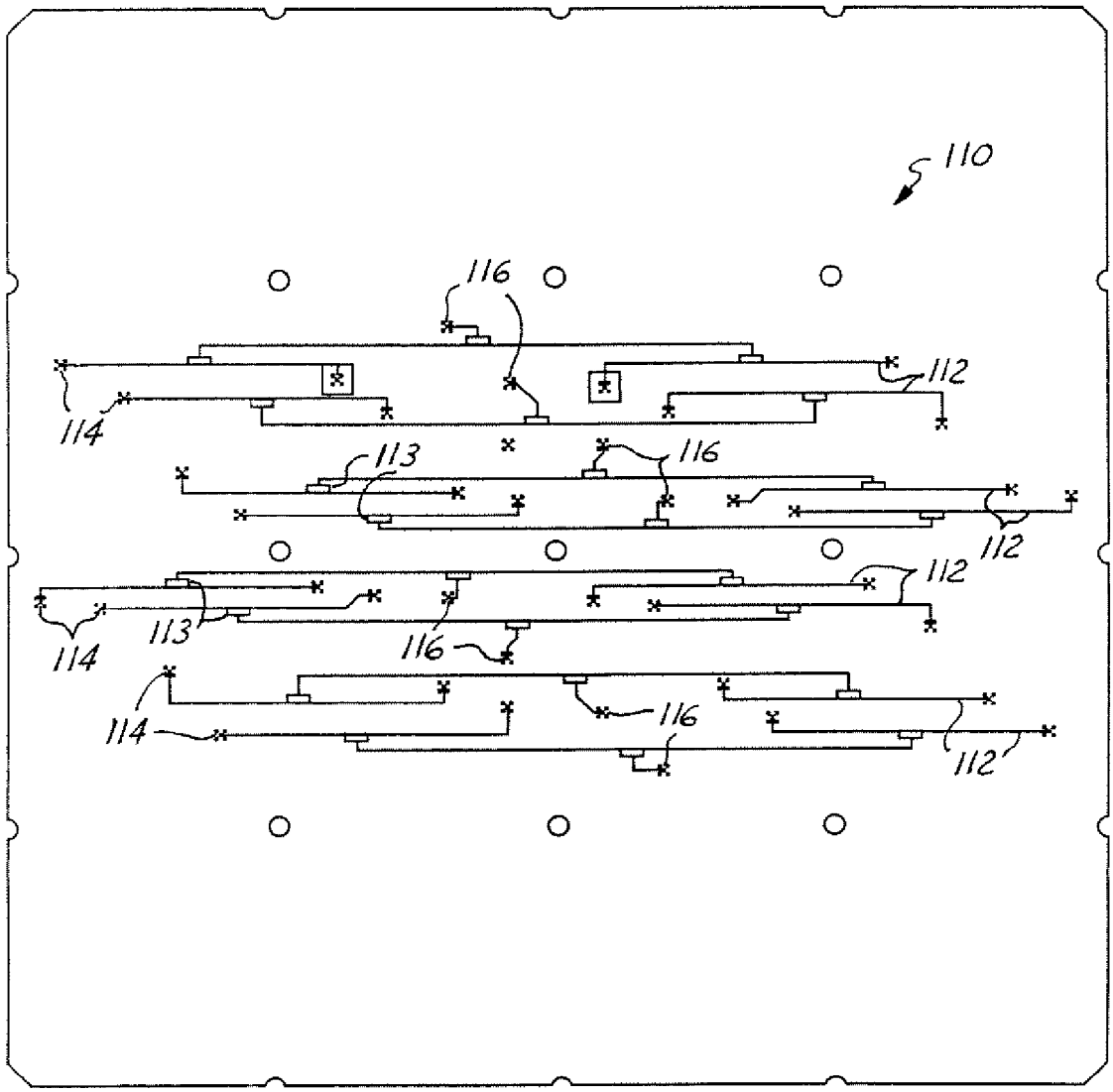
FIG. 6B is a schematic view of a second beamforming layer of the subarray of FIG. 4 in accordance with an embodiment of the present invention.

Referring now to FIG. 6B, a schematic view of a second beamforming layer 110 of the subarray 29 in accordance with an embodiment of the present invention is shown. The second beamforming layer 110 includes a second series of combiner/divider strips 112, which are unidirectionally oriented across the subarray 29 and oppose and are orthogonal to the first series of strips 92. The term "oppose" does not necessarily mean against or directly coupled to, but rather refers to alignment and relative position of the strips 112 relative to the strips 92.

For the embodiment as shown, the second layer 110 includes eight four-to-one combiner/divider strips also having multiple combiner/dividers 113. The combiner/dividers 113 combine the second set of signals to form first combined signals or divide the first combined signals to form the second set of signals, depending upon the mode of operation. The second set of signals corresponds with the connection elements 114 and the first combined signals correspond with the input/output elements 116. The combiner/dividers 113 are coupled between signal connection elements 114 and input/outputs 116. The second layer includes eight input/outputs corresponding to the first eight beams.

The second layer 110 may be coupled above or below the first layer 90. The signal elements 114 of the second layer 110 are coupled to the input/output elements 102. Beam energy may be transferred between the first layer 90 and the second layer 110 via plated through holes in the beamforming array 26.

Figure 7A:
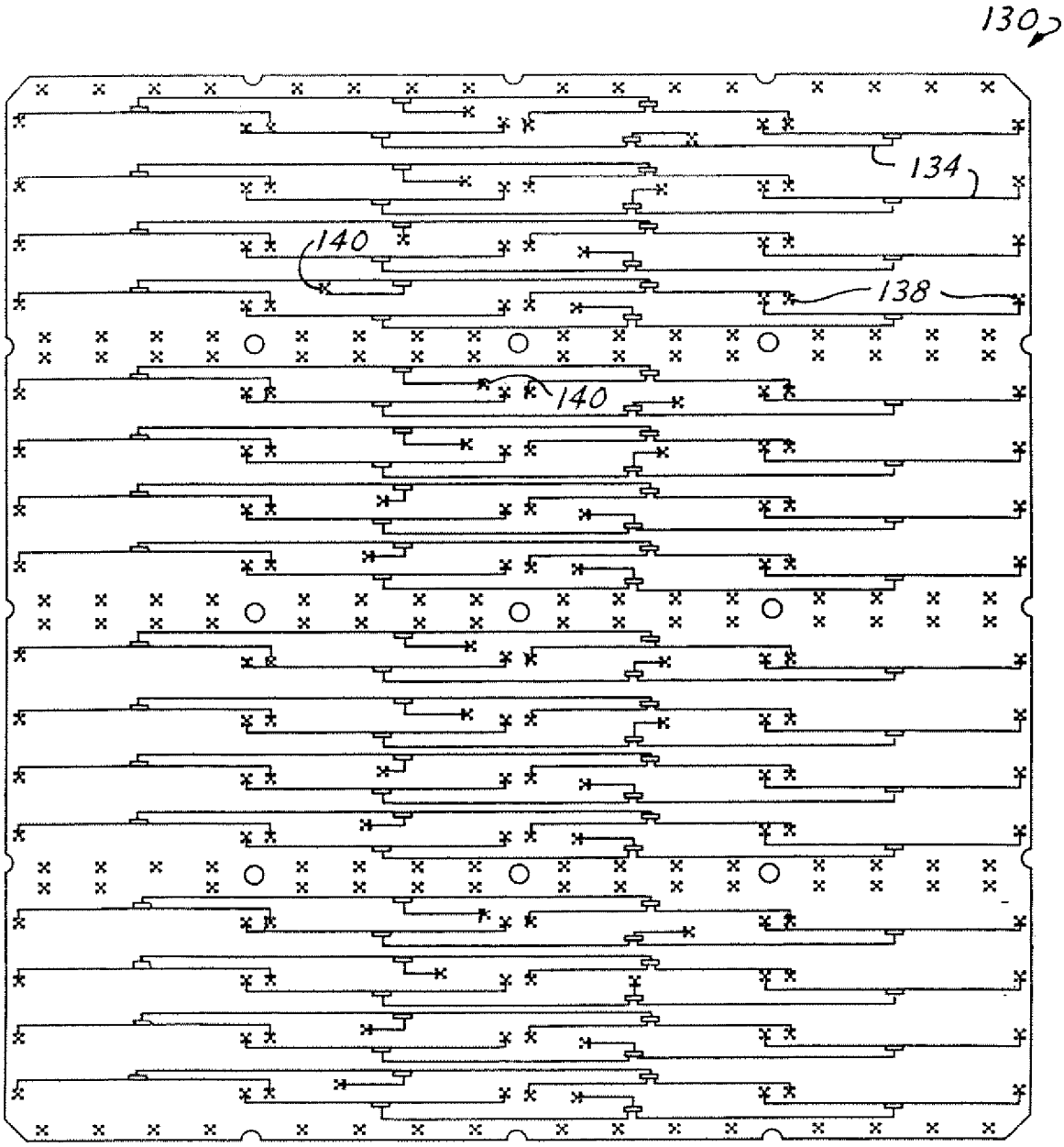
FIG. 7A is a schematic view of a third beamforming layer of the subarray of FIG. 4 in accordance with an embodiment of the present invention.
Figure 7B:
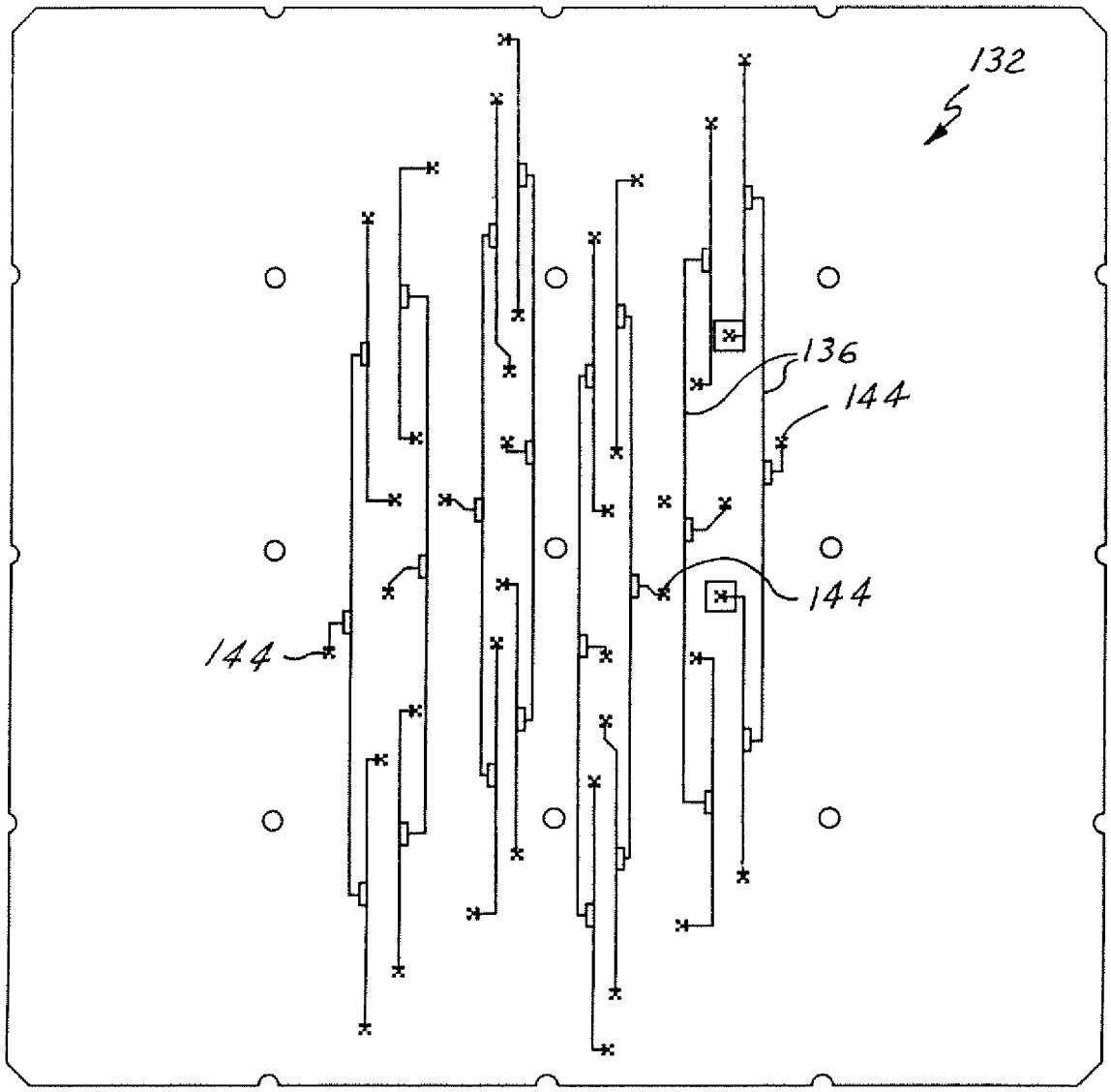
FIG. 7B is a schematic view of a fourth beamforming layer of the subarray of FIG. 4 in accordance with an embodiment of the present invention.

Referring now to FIGS. 7A and 7B, schematic views of a third beamforming layer 130 and a fourth beamforming layer 132 of the subarray 29 are shown in accordance with an embodiment of the present invention. The third layer 130 and the fourth layer are similar to the first layer 90 and the second layer 110, respectively. The third layer 130 includes a third series of combiner/divider strips 134 and the fourth layer 132 includes a fourth series of combiner/divider strips 136. The combiner/divider strips 136 combine a third set of signals, corresponding to beams 9–16, to form a fourth set of signals, or divide the fourth set of signals to form the third set of signals, depending upon the mode of operation. The third set of signals correspond with connection elements 138 and the fourth set of signals correspond with the input/outputs 140, in FIG. 7A. The combiner/divider strips 136 combine the fourth set of signals to form second combined signals or divide the second combined signals to form the fourth set of signals, depending upon the mode of operation. The fourth set of signals correspond with the connection elements 142 and the second combined signals correspond with the input/output connections 144.

Due to the symmetrical distribution of the tile elements 79 around the periphery 80, the beams 9–16 may be derived as beams 1–8. This symmetry allows the same layout used in the layers 90 and 110 to be used in layers 130 and 132 with approximately a 90° rotation of the layers 130 and 132 relative to the layers 90 and 110.

Although the above-described subarray 29 includes four beamforming layers, any number may be utilized. In one embodiment of the present invention, the subarray 29 is formed of two beamforming layers. The two beamforming layers consist of a first layer (not shown) having the first strips 92 and the fourth strips 136, and a second layer (not shown) having the second strips 112 and the third strips 134 integrally formed therein.

The above-described beamforming layer designs aid in reducing height of the antenna 12 to approximately three inches as opposed to approximately thirty-six inches with a traditional centralized beamformer assembly.

The present invention provides a multi-beam phased array antenna assembly with reduced mass, interconnections, number of components, size, integration time, and cost, as well as improved reliability. The architecture of the antenna assembly also eases access to individual components, which increases repair ease. In addition, the antenna array may be scaled for different frequencies and is applicable for both transmit and receive modes of operation.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

The invention claimed is:

1. A subarray beamformer for a multi-beam phased array antenna comprising: a plurality of phased array antenna beamforming layers comprising; a first beamforming layer having a first plurality of combiners in a first orientation and combining a first set of signals to form a second set of signals; second beamforming layer having a second plurality of combiners in a second orientation coupled to and opposing said first plurality of combiners, said second plurality of combiners combining said second set of signals to form at least one first combined signal, a third beamforming layer having a third plurality of combiners in a third orientation and combining a third set of signals to form a fourth set of signals; and a fourth beamforming layer having a fourth plurality of combiners in a fourth orientation coupled to and opposing said third plurality of combiners, said fourth plurality of combiners combining said fourth set of signals to form at least one second combined signal, wherein said first plurality of combiners are in a first unidirectional orientation and said second plurality of combiners are in a second unidirectional orientation orthogonal to said first unidirectional orientation.

2. A beamformer as in claim 1 wherein said third plurality of combiners are in a third unidirectional orientation and said fourth plurality of combiners are in a fourth unidirectional orientation orthogonal to said third unidirectional orientation.

3. A beamformer as in claim 1 wherein said first beamforming layer and said fourth beamforming layer are formed as a single beamforming layer.

4. A beamformer as in claim 1 wherein said second beamforming layer and said third beamforming layer are formed as a single beamforming layer.

5. A beamformer as in claim 1 wherein said fourth beamforming layer comprises fewer combiners than said third beamforming layer.

6. A beamformer as in claim 1 wherein said second beamforming layer comprises fewer combiners than said first beamforming layer.

7. An assembly as in claim 1 wherein said subarray beamformer comprises fewer beamforming layers than a quantity of radiating elements coupled thereto.

8. A beamformer as in claim 1 wherein each combiner within said first plurality of combiners and said second plurality of combiners combine signals received from each tile within a beamforming subarray of tiles.

9. A multi-beam phased array antenna assembly comprising: a plurality of radiating elements receiving a plurality of beams having a first set of signals; a common structure coupled to said plurality of radiating elements; a plurality of signal conditioners coupled to said common structure; and a subarray beamformer coupled to said plurality of signal conditioners and comprising; a plurality of phased array antenna beamforming layers comprising; a first beamforming layer having a first plurality of combiners in a first orientation and combining said first set of signals to form a second set of signals; and a second beamforming layer having a second plurality of combiners in a second orientation coupled to and opposing said first plurality of combiners, said second plurality of combiners combining said second set of signals to form at least one first combined signal, a third beamforming layer having a third plurality of combiners in a third orientation and combining a third set of signals to form a fourth set of signals; and a fourth beamforming layer having a fourth plurality of combiners in a fourth orientation coupled to and opposing said third plurality of combiners, said fourth plurality of combiners combining said fourth set of signals to form at least one second combined signal.

10. An assembly as in claim 9 further comprising a cover coupled to said subarray beamformer.

11. An assembly as in claim 9 wherein said subarray beamformer comprises fewer beamforming layers than a quantity of radiating elements within said plurality of radiating elements.

12. A multi-beam phased array antenna assembly comprising: a plurality of radiating elements transmitting a plurality of beams having a first set of signals; a common structure coupled to said plurality of radiating elements; a plurality of signal conditioners coupled to said common structure; and a subarray beamformer coupled to said plurality of signal conditioners and comprising; a plurality of phased array antenna beamforming layers comprising; a second beamforming layer having a second plurality of dividers in a second orientation and dividing at least one first combined signal to form a second set of signals; and a first beamforming layer having a first plurality of dividers in a first orientation coupled to and opposing said second plurality of dividers, said first plurality of dividers dividing said second set of signals to form said first set of signals, said plurality of phased array antenna beamforming layers further comprising: a fourth beamforming layer having a forth plurality of dividers on a fourth orientation and dividing at least one second combined signal to form a fourth set of signals; and a third beamforming layer having a third plurality of dividers in a third orientation coupled to and opposing said fourth plurality of dividers, said third plurality of dividers said fourth set of signals to form a third set of signals.

13. An assembly as in claim 12 further comprising a cover coupled to said subarray beamformer.

14. An assembly as in claim 12 wherein said subarray beamformer comprises fewer beamforming layers than a quantity of radiating elements within said plurality of radiating elements.

15. A satellite having a multi-beam phased array antenna assembly comprising; a plurality of radiating elements receiving a plurality of beams having a first set of signals; a common structure coupled to said plurality of radiating elements; a plurality of signal conditioners coupled to said common structure; and a subarray beamformer coupled to said plurality of signal conditioners and comprising; a plurality of phased array antenna beamforming layers comprising; a first beamforming layer having a first plurality of combiners in a first orientation and combining said first set of signals to form a second set of signals; and a second beamforming layer having a second plurality of combiners in a second orientation coupled to and opposing said first plurality of combiners, said second plurality of combiners combining said second set of signals to form at least one first combined signal, a third beamforming layer having a third plurality of combiners in a third orientation and combining a third set of signals to form a fourth set of signals; and a fourth beamforming layer having a fourth plurality of combiners in a fourth orientation coupled to and opposing said third plurality of combiners, said fourth plurality of combiners combining said fourth set of signals to form at least one second combined signal.

16. A satellite as in claim 15 wherein said subarray beamformer comprises fewer beamforming layers than a quantity of radiating elements within said plurality of radiating elements.

17. A satellite having a multi-beam phased array antenna assembly comprising: a plurality of radiating elements transmitting a plurality of beams having a first set of signals; a common structure coupled to said plurality of radiating elements; a plurality of signal conditioners coupled to said common structure; and a subarray beamformer coupled to said plurality of signal conditioners comprising; a plurality of phased array antenna beamforming layers comprising; a second beamforming layer having a second plurality of dividers in a second orientation and dividing at least one first combined signal to form a second set of signals; a first beamforming layer having a first plurality of dividers in a first orientation coupled to and opposing said second plurality of dividers, said first plurality of dividers dividing said second set of signals to form said first set of signals, a third beamforming layer having a third plurality of combiners in a third orientation and combining a third set of signals to form a fourth set of signals; and a fourth beamforming layer having a fourth plurality of combiners in a fourth orientation coupled to and opposing said third plurality of combiners, said fourth plurality of combiners combining said forth set of signals to form at least one second combined signal.

18. A satellite as in claim 17 wherein said subarray beamformer comprises fewer beamforming layers than a quantity of radiating elements within said plurality of radiating elements.

19. A method of forming a multi-beam phased array antenna assembly comprising: manufacturing a common structure configured to couple a plurality of radiating elements to a plurality of signal conditioners; coupling a beamforming board to said plurality of signal conditioners; coupling a plurality of tile elements between said plurality of radiating elements and said beamforming board and within said common structure; and encasing said plurality of signal conditioners and said beamforming board in said common structure.

20. A subarray beamformer for a multi-beam phased array antenna comprising: a plurality of phased array antenna beamforming layers comprising; a second beamforming layer having a second plurality of dividers in a second orientation and dividing at least one first combined signal to form a second set of signals; and a first beamforming layer having a first plurality of dividers in a first orientation coupled to and opposing said second plurality of dividers, said first plurality of dividers dividing said second set of signals to form a first set of signals, wherein said first plurality of dividers are in a first unidirectional orientation and said second plurality of dividers are in a second unidirectional orientation orthogonal to said first unidirectional orientation, a third beamforming layer having a third plurality of combiners in a third orientation and combining a third set of signals to form a fourth set of signals; and a fourth beamforming layer having a fourth plurality of combiners on a fourth orientation coupled to and opposing said third plurality of combiners, said fourth plurality of combiners combining said fourth set of signals to form at least one second combined signal.

21. A beamformer as in claim 20 wherein said second beamforming layer comprises fewer dividers than said first beamforming layer.

22. A beamformer as in claim 20 wherein said subarray beamformer comprises fewer beamforming layers than a quantity of radiating elements coupled thereto.

23. A beamformer as in claim 20 wherein each divider within said first plurality of dividers and said second plurality of dividers divide signals for each tile within a beamforming subarray of tiles.

24. A subarray beamformer for a multi-beam phased array antenna comprising: a plurality of phased array antenna beamforming layers comprising; a second beamforming layer having a second plurality of dividers in a second orientation and dividing at least one first combined signal to form a second set of signals; and a first beamforming layer having a first plurality of dividers in a first orientation coupled to and opposing said second plurality of dividers, said first plurality of dividers dividing said second set of signals to form a first set of signals, wherein said plurality of phased array antenna beamforming layers further comprise: a fourth beamforming layer having a fourth plurality of dividers in a fourth orientation and dividing at least one second combined signal to form a fourth set of signals; and a third beamforming layer having a third plurality of dividers in a third orientation coupled to and opposing said fourth plurality of dividers, said third plurality of dividers dividing said fourth set of signals to form a third set of signals.

25. A beamformer as in claim 24 wherein said third plurality of dividers are in a third unidirectional orientation and said fourth plurality of dividers are in a fourth unidirectional orientation orthogonal to said third unidirectional orientation.

26. A beamformer as in claim 24 wherein said first beamforming layer and said fourth beamforming layer are formed as a single beamforming layer.

27. A beamformer as in claim 24 wherein said second beamforming layer and said third beamforming layer are formed as a single beamforming layer.

28. A beamformer as in claim 24 wherein said fourth beamforming layer comprises fewer dividers than said third beamforming layer.

29. A subarray beamformer for a multi-beam phased array antenna comprising: a plurality of phased array antenna beamforming layers comprising; a second beamforming layer having a second plurality of dividers in a second orientation and dividing at least one first combined signal to form a second set of signals; and a first beamforming layer having a first plurality of dividers in a first orientation coupled to and opposing said second plurality of dividers, said first plurality of dividers dividing said second set of signals to form a first set of signals, wherein said first plurality of dividers are in a first unidirectional orientation and said second plurality of dividers are in a second unidirectional orientation orthogonal to said first unidirectional orientation, and wherein said plurality of phased array antenna beamforming layers further comprise: a fourth beamforming layer having a fourth plurality of dividers in a fourth orientation and dividing at least one second combined signal to form a fourth set of signals; and a third beamforming layer having a third plurality of dividers in a third orientation coupled to and opposing said fourth plurality of dividers, said third plurality of dividers dividing said fourth set of signals to form a third set of signals.

* * * * *